US008684772B2

(12) United States Patent
Yu et al.

(10) Patent No.: US 8,684,772 B2
(45) Date of Patent: Apr. 1, 2014

(54) ELECTRICAL CONNECTOR

(75) Inventors: Wang-I Yu, Jhonghe (TW); Kuo-Cheng Liu, Jhonghe (TW); Zi-Yun Xia, Taicang (CN)

(73) Assignee: Alltop Electronics (Suzhou) Ltd., Taicang, JiangSu Province (CN)

( * ) Notice: Subject to any disclaimer, the term of this patent is extended or adjusted under 35 U.S.C. 154(b) by 15 days.

(21) Appl. No.: 13/397,013

(22) Filed: Feb. 15, 2012

(65) Prior Publication Data

US 2013/0164998 A1 Jun. 27, 2013

(30) Foreign Application Priority Data

Dec. 27, 2011 (CN) ..... 2011 1 0444270

(51) Int. Cl.
*H01R 9/22* (2006.01)

(52) U.S. Cl.
USPC ..... 439/717

(58) Field of Classification Search
USPC ..... 439/717, 701
See application file for complete search history.

(56) References Cited

U.S. PATENT DOCUMENTS

| | | | | | |
|---|---|---|---|---|---|
| 3,273,107 | A * | 9/1966 | Chandler | 439/717 |
| 4,082,408 | A * | 4/1978 | Angelis | 439/698 |
| 4,171,862 | A * | 10/1979 | Krasser | 439/717 |
| 4,322,120 | A * | 3/1982 | Rilling | 439/631 |
| 4,729,744 | A * | 3/1988 | Bet et al. | 439/717 |
| 4,753,614 | A * | 6/1988 | Weiner | 439/717 |
| 5,415,566 | A * | 5/1995 | Brunker et al. | 439/607.11 |
| 6,059,615 | A * | 5/2000 | Pendleton et al. | 439/717 |
| 6,077,127 | A * | 6/2000 | Wu | 439/717 |
| 6,354,887 | B2 * | 3/2002 | Maeda | 439/701 |
| 6,619,997 | B1 * | 9/2003 | Wilson et al. | 439/701 |
| 6,743,057 | B2 * | 6/2004 | Davis et al. | 439/701 |
| 6,945,828 | B2 * | 9/2005 | Kamei et al. | 439/717 |
| 7,175,479 | B1 * | 2/2007 | McAlonis et al. | 439/701 |
| 7,195,519 | B1 * | 3/2007 | McAlonis et al. | 439/607.39 |
| 7,390,219 | B2 * | 6/2008 | Pan | 439/607.13 |
| 7,572,156 | B2 | 8/2009 | Schroll et al. | |
| 7,588,463 | B2 * | 9/2009 | Yamada et al. | 439/607.05 |
| 7,713,077 | B1 * | 5/2010 | McGowan et al. | 439/249 |
| 7,837,514 | B2 * | 11/2010 | Fogg | 439/701 |
| 2002/0146941 | A1 * | 10/2002 | Bradley | 439/701 |
| 2010/0041266 | A1 * | 2/2010 | Data et al. | 439/358 |

* cited by examiner

*Primary Examiner* — Gary Paumen
(74) *Attorney, Agent, or Firm* — Sughrue Mion, PLLC

(57) ABSTRACT

An electrical connector includes an insulating housing having a number of passageways and a number of dividing walls extending from a rear side of the passageways; and a number of contact modules received in the insulating housing and arranged along a first direction. Each contact module includes an insulator and a number of conductive contacts received in the insulator. Each insulator includes a first section and a second section. The dimension of the first section along the first direction is larger than the dimension of the second section. When the contact modules are assembled to the insulating housing, the second sections are received in corresponding dividing walls, respectively.

9 Claims, 14 Drawing Sheets

ELECTRICAL CONNECTOR

BACKGROUND OF THE INVENTION

1. Field of the Invention

The present invention relates to an electrical connector, and more particularly to an electrical connector mountable on a printed circuit board.

2. Description of Related Art

U.S. Pat. No. 7,572,156, issued on Aug. 11, 2009, discloses a conventional electrical connector. A contact module is configured to be held by a housing of the electrical connector adjacent two other contact modules. The contact module includes at least one electrical lead, and a body holding at least a portion of the at least one electrical lead. The electrical lead has a contacting end extending out of the body. Obviously, the contacting end of the electrical lead is easily subject to a undesired deformation.

Hence, an electrical connector with improved structure to overcome above-described shortcoming is needed.

BRIEF SUMMARY OF THE INVENTION

The present invention provides an electrical connector for mounting to a printed circuit board. The electrical connector comprises an insulating housing comprising a plurality of passageways and a plurality of dividing walls extending from a rear side of the plurality of passageways; and a plurality of contact modules received in the insulating housing and arranged along a first direction. Each contact module comprises an insulator and a plurality of conductive contacts received in the insulator. Each insulator comprises a first section and a second section. The dimension of the first section along the first direction is larger than the dimension of the second section. When the contact modules are assembled to the insulating housing, the second sections are received in corresponding dividing walls, respectively.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
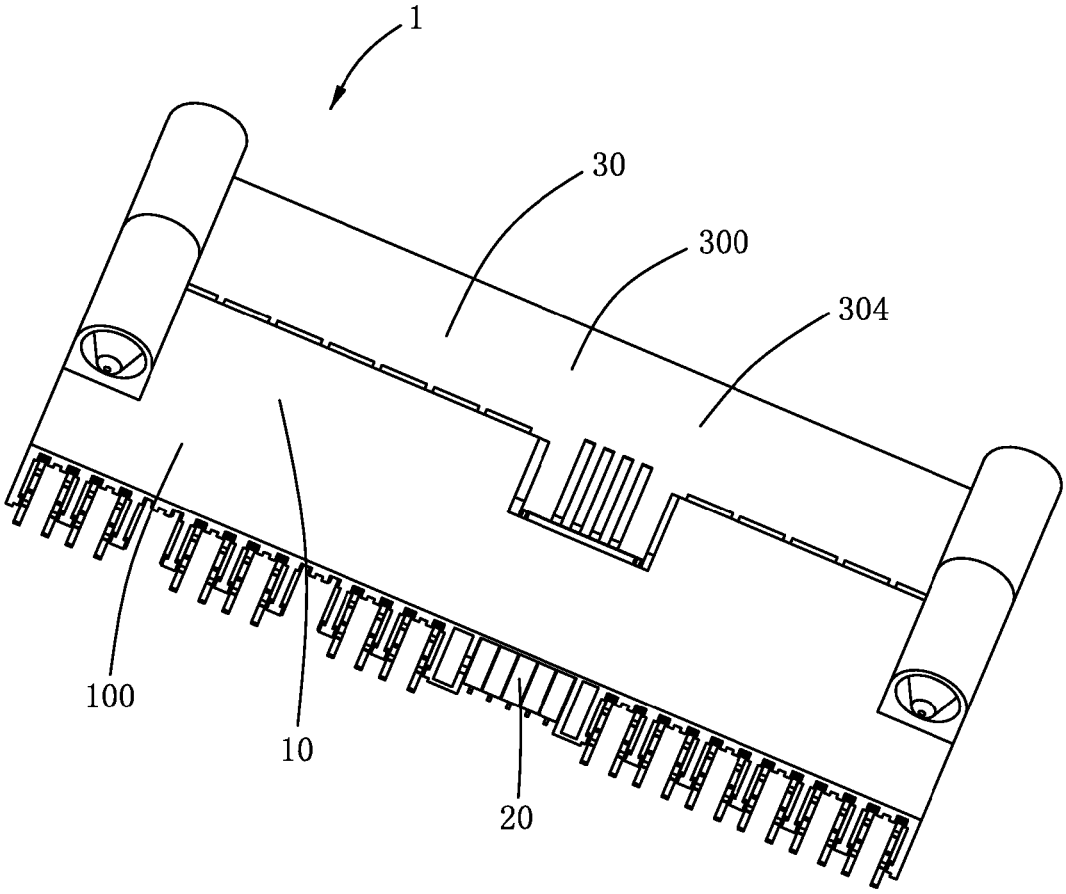
FIG. 1 is a perspective view of a first electrical connector and a second electrical connector in accordance with the present invention.
Figure 2:
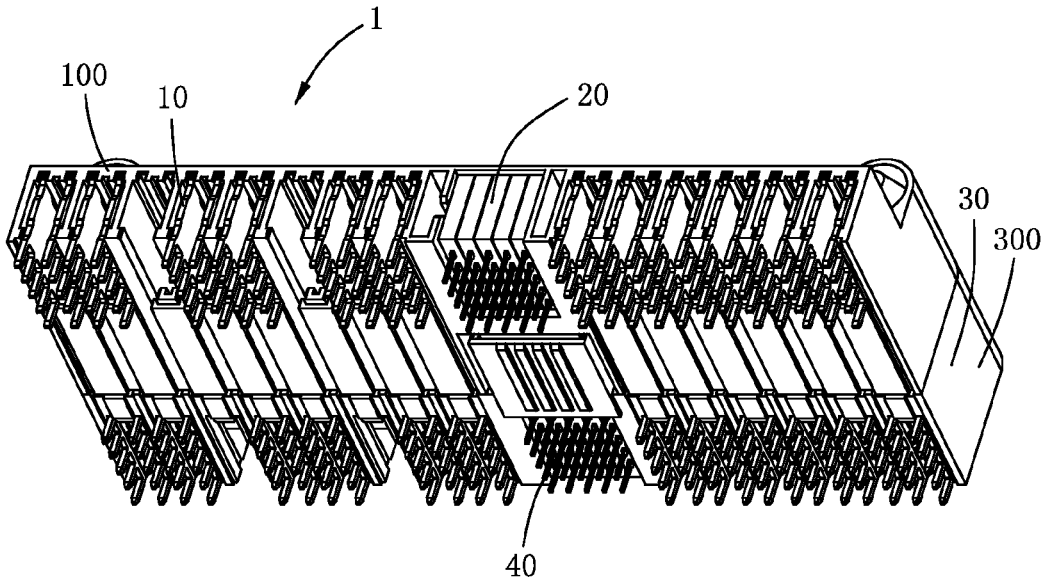
FIG. 2 is another perspective view of the first and the second electrical connectors shown in FIG. 1.
Figure 3:
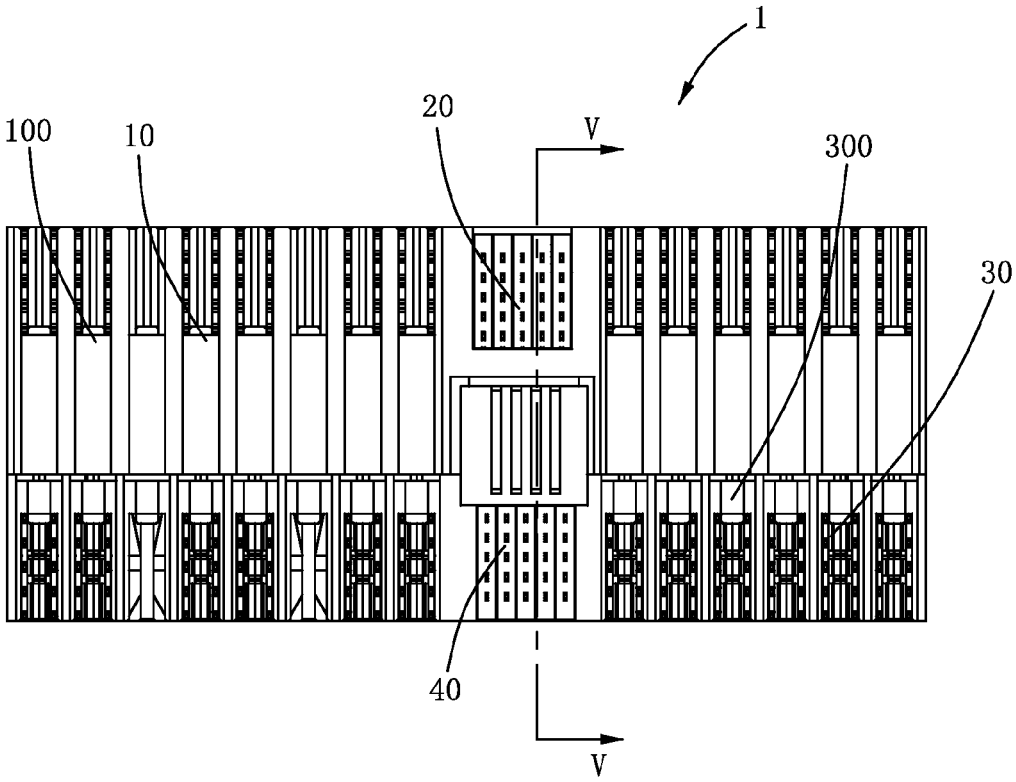
FIG. 3 is a bottom view of the first and the second electrical connectors.
Figure 4:
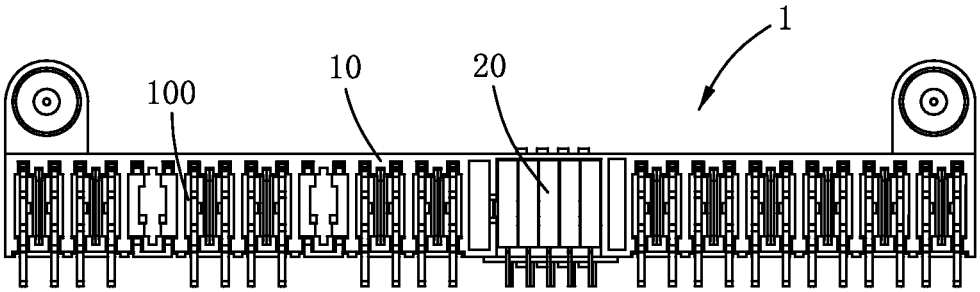
FIG. 4 is a rear view of the first and the second electrical connectors.
Figure 5:
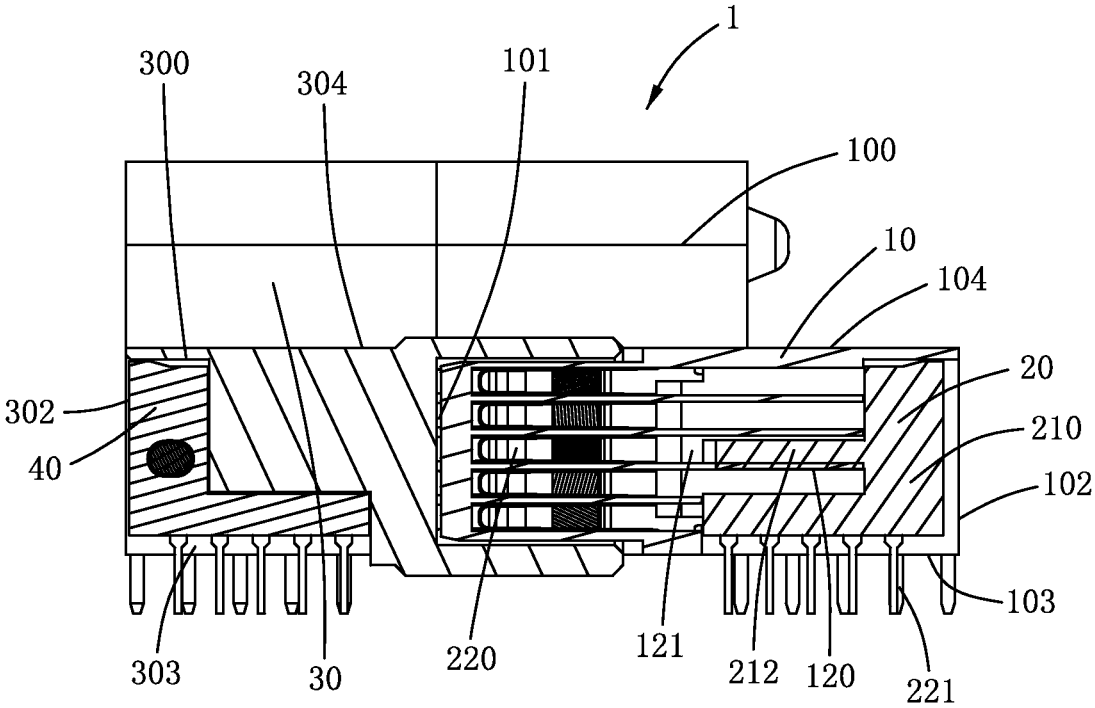
FIG. 5 is a cross-sectional view taken along line V-V of FIG. 3.
Figure 6:
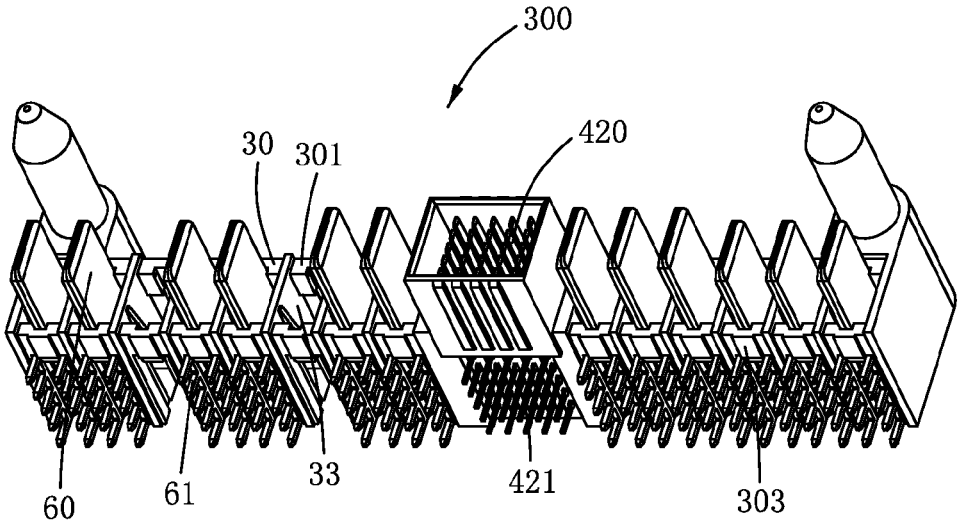
FIG. 6 is a perspective view of the second electrical connector.
Figure 7:
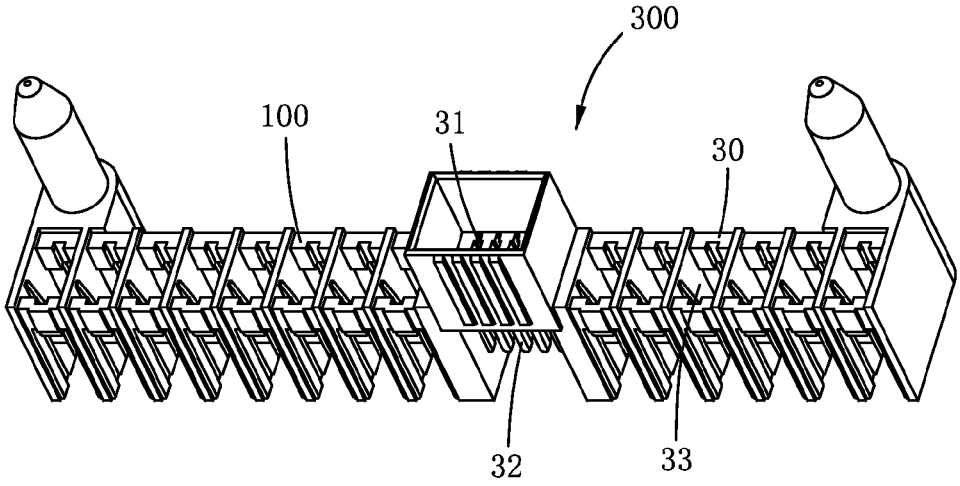
FIG. 7 is a perspective view of a second insulating housing of the second electrical connector shown in FIG. 6.
Figure 8:
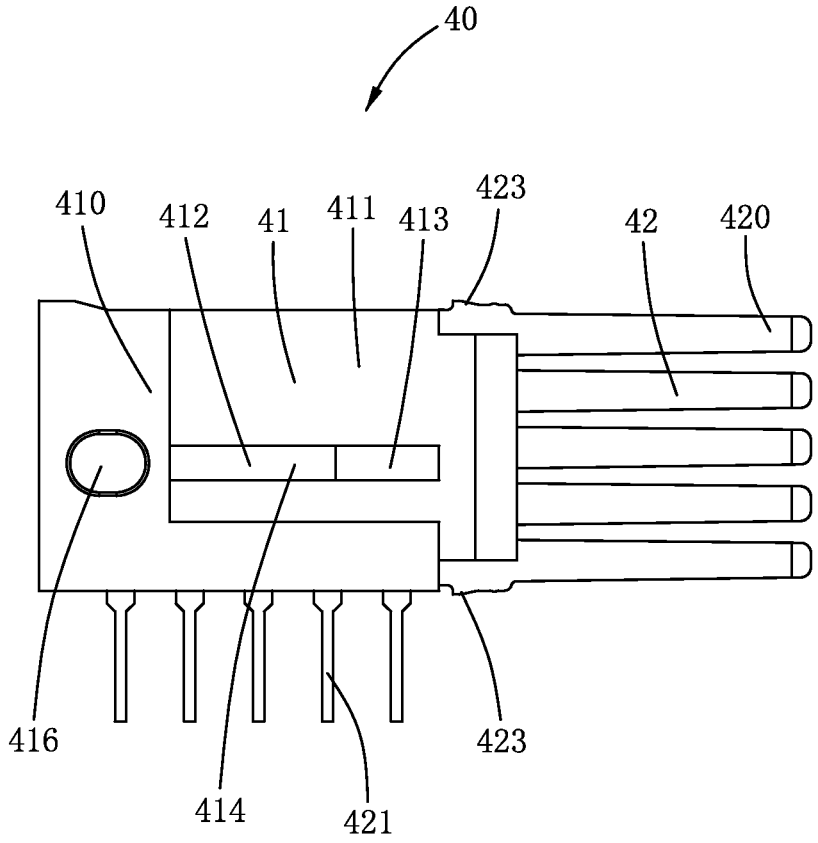
FIG. 8 is a side view of a second signal contact module of the second electrical connector.
Figure 9:
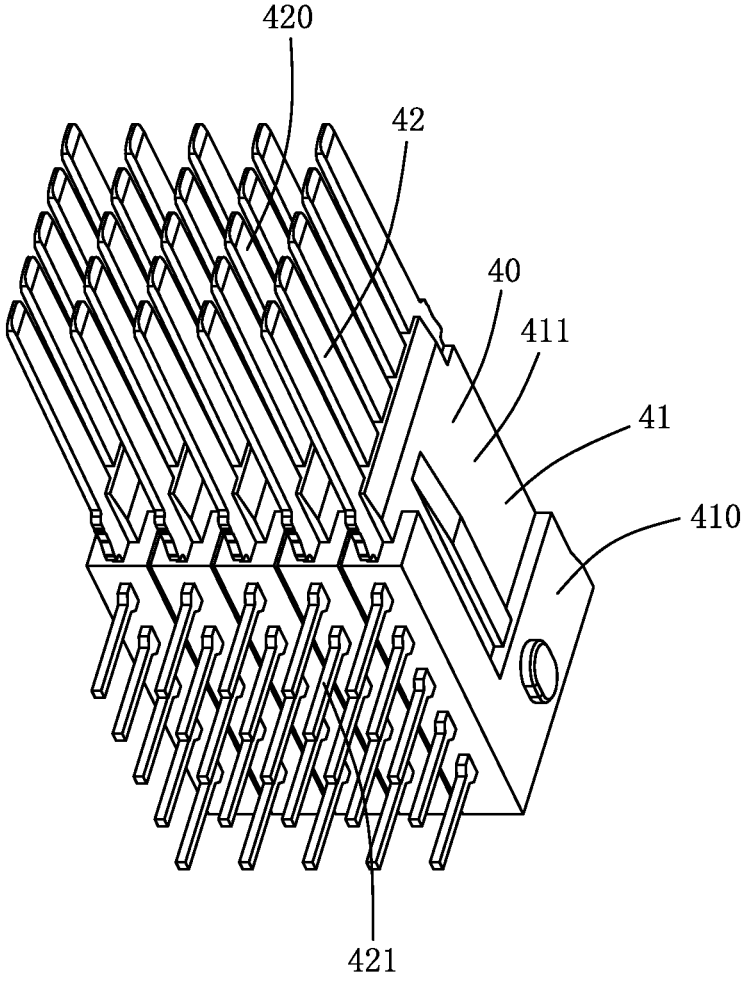
FIG. 9 is an assembled view of the second signal contact modules of the second electrical connector.
Figure 10:
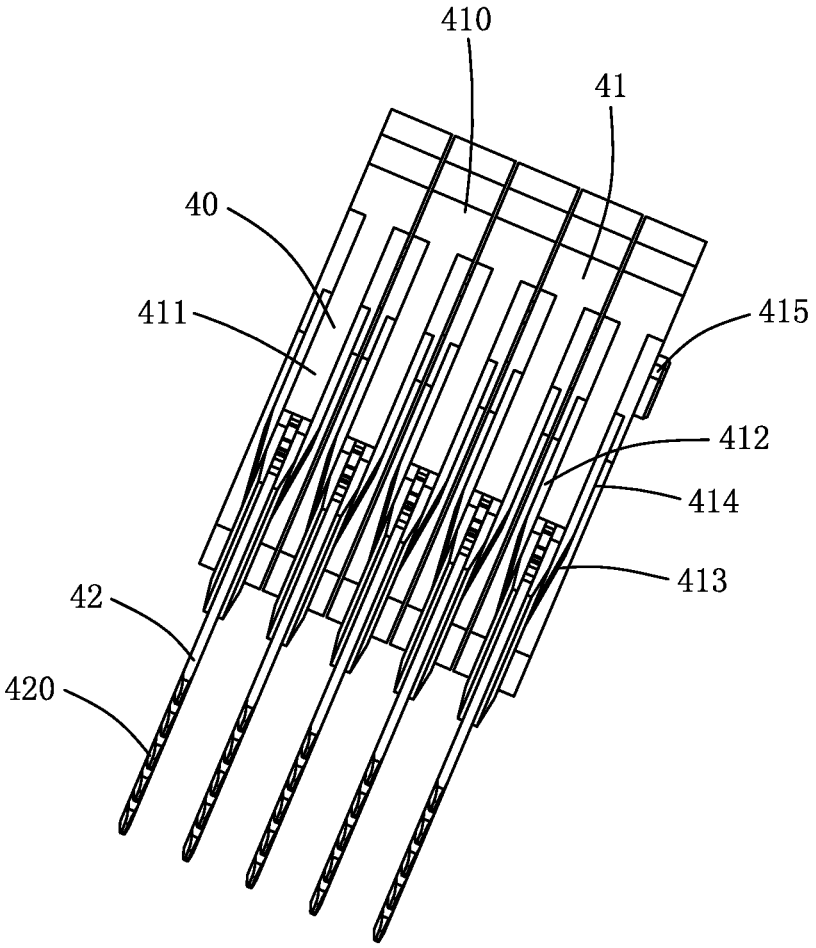
FIG. 10 is a view similar to FIG. 9 while taken from another aspect.
Figure 11:
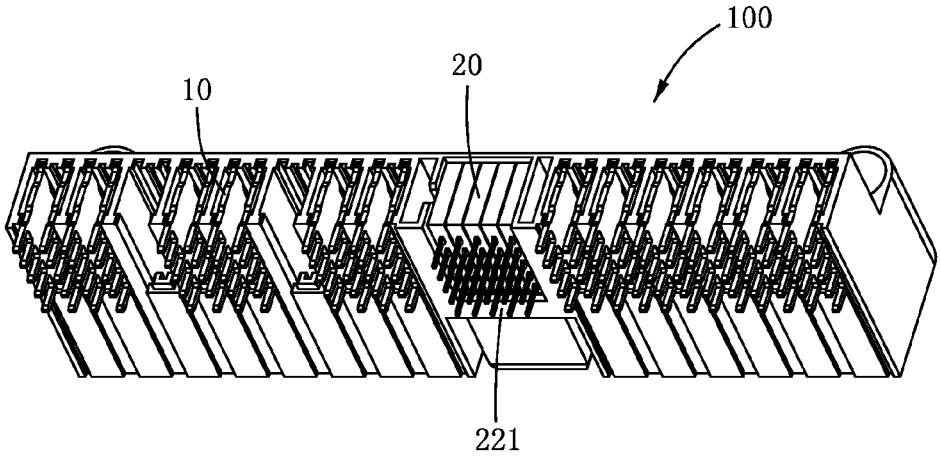
FIG. 11 is a perspective view of the first electrical connector.
Figure 12:
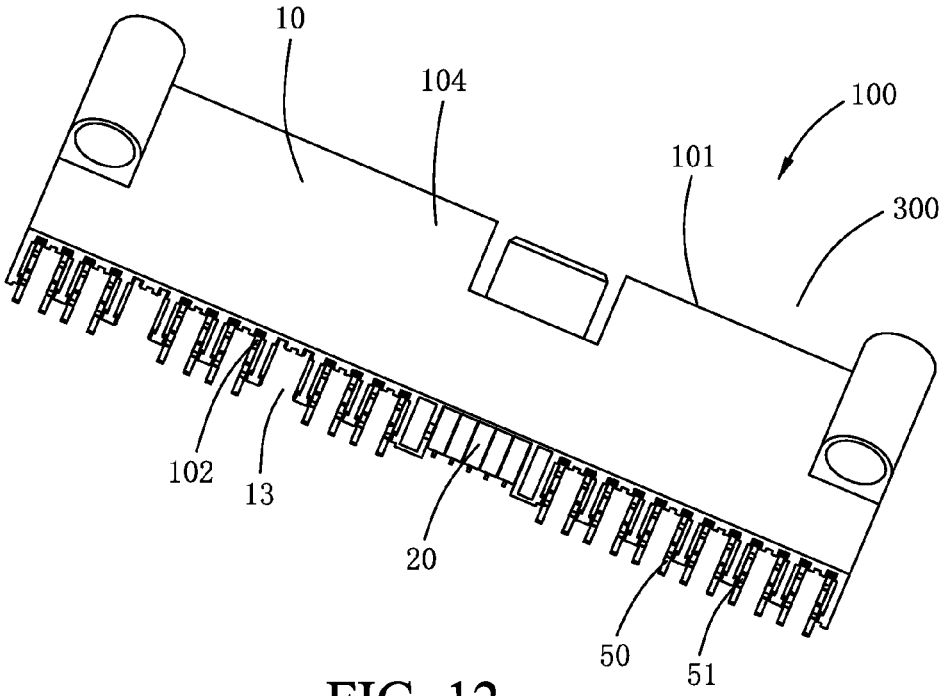
FIG. 12 is a view similar to FIG. 11 while taken from another aspect.
Figure 13:
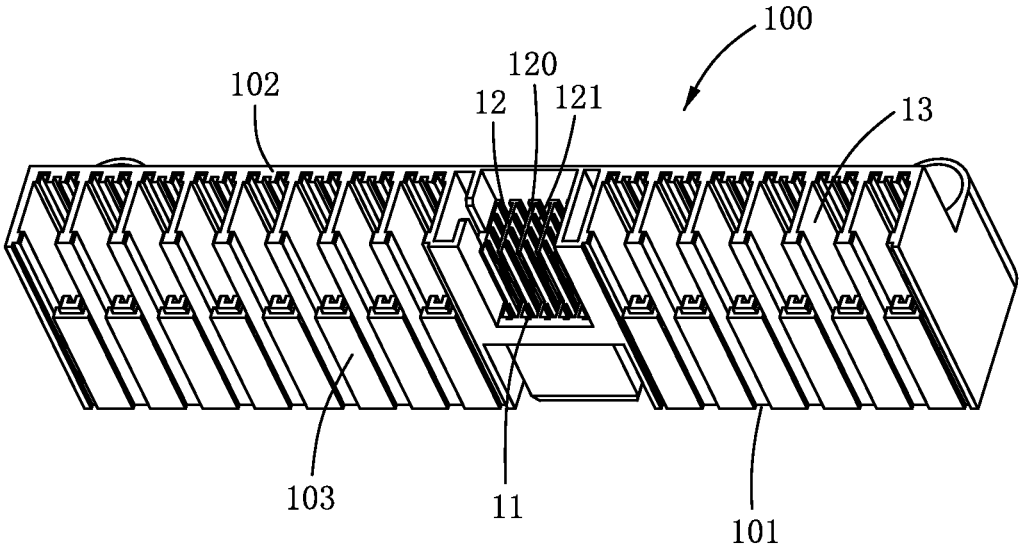
FIG. 13 is a perspective view of the first insulating housing of the first electrical connector.
Figure 14:
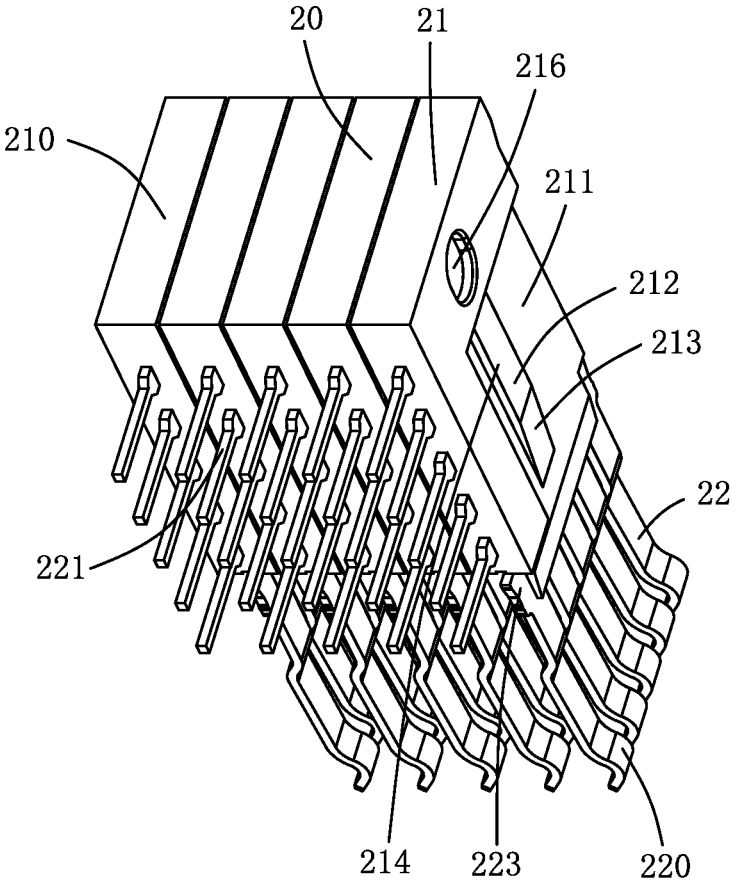
FIG. 14 is an assembled view of the first signal contact modules of the first electrical connector.
Figure 15:
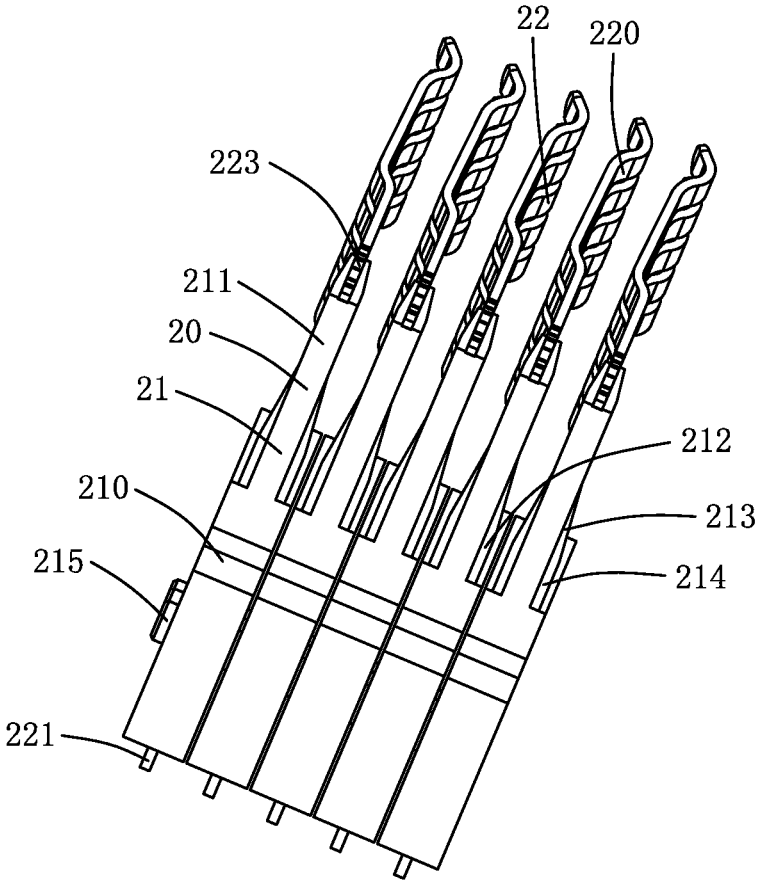
FIG. 15 is a view similar to FIG. 14 while taken from another aspect.
Figure 16:
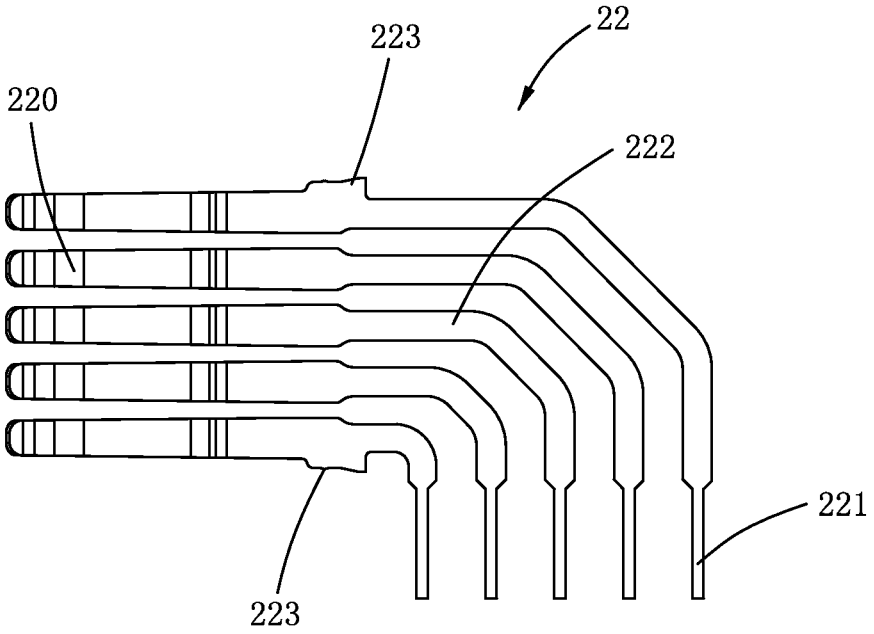
FIG. 16 is a side view of the first signal contacts.

Reference will now be made to the drawing figures to describe the embodiments of the present invention in detail. In the following description, the same drawing reference numerals are used for the same elements in different drawings.

Referring to FIGS. 1-4, an electrical connector assembly in accordance with the present invention including a first electrical connector 100 and a second electrical connector 300 mating with the first electrical connector 100. The first electrical connector 100 comprises a first insulating housing 10, a plurality of first signal contact modules 20 received in the first insulating housing 10, and a plurality of first power contacts 50 assembled within the first insulating housing 10. The second electrical connector 300 comprises a second insulating housing 30, a plurality of second signal contact modules 40, which are mating with corresponding first signal contact modules 20, and a plurality of second power contacts 60. In the preferred embodiment, the first electrical connector 100 has five first signal contact modules 20 and fourteen first power contacts 50. Each of first signal contact module 20 includes four first signal conductive contacts 22. The first power contacts 50 are divided into two groups arranged at opposite sides of the first signal contact modules 20. As can be understood, the number and the arrangement of the first signal contacts, the first signal modules and the first power contacts in other embodiments can be different according to application requirements. Similarly, the second electrical connector 300 has a structure correspondingly configured to mate with the first electrical connector 100.

Referring to FIGS. 1-5 together with FIGS. 11-16, the first insulating housing 10 includes a front face 101, a rear face 102 opposite to the front face 101, a bottom face 103 and a top face 104 connecting the front and the rear faces. A plurality of first passageways 11 are opened from the front face 101 and are arranged in columns and lines. The first insulating housing 10 also includes a plurality of first dividing walls 12 extending from the first passageway 11 towards the rear face 102. Each first dividing wall 12 is arranged between two adjacent columns of first passageways 11. Each first dividing wall 12 provides a plurality of first protrusions 120 on opposite sides thereof. A first receiving channel 121 is defined between first protrusions 120 of adjacent dividing walls 12.

The first insulating housing comprises a plurality of first power contact passageways 13 for receiving corresponding first power contacts 50.

The first signal contact modules 20 are arranged side by side along a first direction. The first signal contact module 20 includes a first insulator 21 and a plurality of first signal contacts 22 retained in the first insulator 21. The first insulator 21 comprises a first section 210 and a second section 211. The dimension of the first section 210 is larger than the dimension of the second section 211 along the first direction. When the first signal contact module 20 is assembled to the insulating housing 10, the second section of the first signal contact module 20 is received in neighbored two first dividing walls 12. The first section 210 of the first insulator 21 defines a projection 215 on one side thereof and a receiving hole 216 on an opposite side thereof. The two neighbored first signal contact modules 20 are combined with each other by the engaging between the projection 215 on one module and the receiving hole 216 on other module. The second section 211 of the first insulator 21 defines a first block 212 receivable in the first receiving channel 121 on each opposite side thereof The first block 212 comprises a guiding portion 213 and a main portion 214.

Each first signal contact 22 includes a first contacting portion 220 for mating with the complementary second electrical connector 300, a first mounting portion 221 for mounting to a printed circuit board (not shown), and a first intermediate portion 222 connecting the first contacting portion 220 and the first mounting portion 221. In the preferred embodiment, the first signal contacts 22 located in the uppermost side and the lowermost side of the first signal contact module 20 have barbs 223 thereon for interference fitting in the first insulating housing 10. In the preferred embodiment, the first power contact 50 comprises a pair of separated power contact halves 51. In other embodiments, the first power contacts 50 can be provided in the module just as the similar construction of the first signal contact module 20.

Referring to FIGS. 1-10, the second insulating housing 30 defines a front face 301, a rear face 302 opposite to the front face 301, a bottom face 303 and a top face 304 connecting the front face 301 and the rear face 302. The second insulating housing 30 defines a plurality of second passageways 31 and a plurality of second dividing walls 32. The second dividing wall 32 extends from the second passageway 31 towards the rear face 302 and is positioned between two adjacent columns of the second passageways 31. Similar to the first dividing wall 12, the second dividing wall 32 also defines a protrusion and a receiving channel (not shown) thereon. The second insulating housing 30 comprises a plurality of second power contact passageways 33 extending therethrough for receiving the second power contacts 60.

Figure 17:
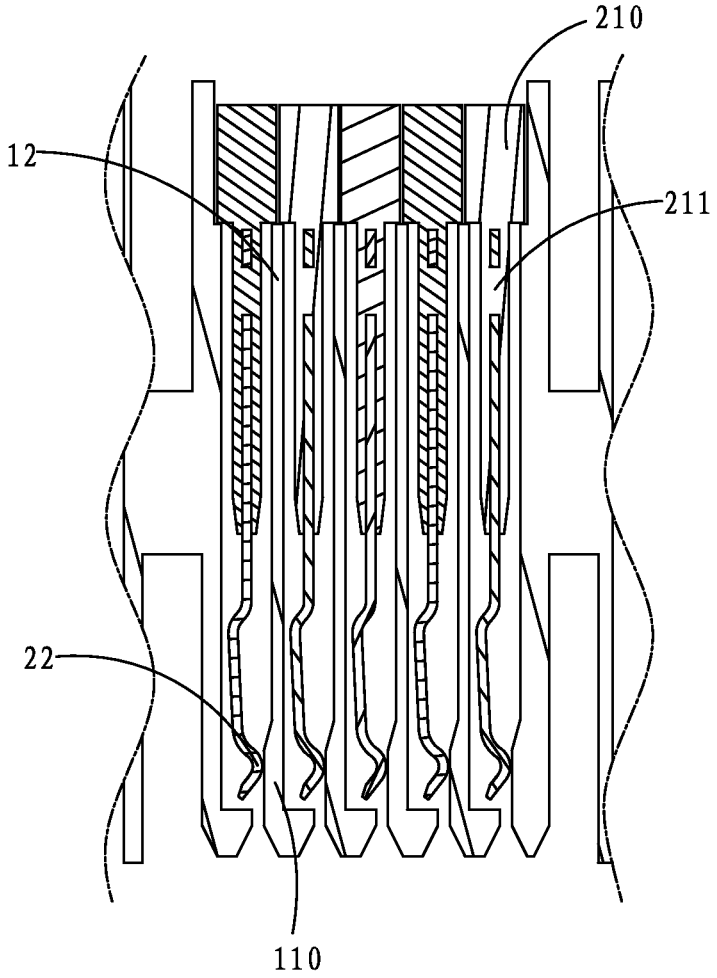
FIG. 17 is a partial cross-sectional view of the first insulating housing of the first electrical connector.

The plurality of second signal contact modules 40 are positioned side by side along the first direction. Each second signal contact module 40 includes a second insulator 41 and a plurality of second signal contacts 42 retained in the second insulator 41. The second insulator 41 includes a third section 410 and a forth section 411. The dimension of the third section 410 is larger than the dimension of the forth section 411 along the first direction. When the second signal contact module 40 is inserted into the second insulating housing 30, the forth section 41 is received in the neighbored second dividing walls 32. The forth section 411 of the second insulator 41 defines thereon a second blocks 412 received in the second receiving channel. The third section 410 of the second insulator 41 defines a projection 415 at one side thereof and a receiving hole 416 at the opposite side thereof. The two neighbored second signal contact modules 20 are combined with each other by the engaging between the projection on one module and the receiving hole on the other module. The forth section 411 of the second insulator 41 defines a second block 412 receivable in the second receiving channel on each opposite side thereof. The second block 412 comprises a guiding portion 413 and a main portion 414. Each second signal contact 42 has a second contacting portion 420, a second mounting portion 421 and a second intermediate portion (not shown) connecting the second contacting portion 420 and the second mounting portion 421. The first insulating housing 10 defines an abutting block 111 in the first passageway 11 (FIG. 17) in order to avoid undesired deformation of the first and the second contacting portions when engagement. In the preferred embodiment, the second signal contacts 42 located in the uppermost side and the lowermost side of the second signal contact module 40 have barbs 223 thereon for interference fitting in the second insulating housing 30. In the preferred embodiment, the second power contact 60 comprises a pair of separated power contact halves 61 abutting against each other. In other embodiments, the second power contacts 60 can be provided in the module just as the similar construction of the second signal contact module 40.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector mountable on a printed circuit board (PCB), comprising:

an insulating housing comprising a plurality of passageways and a plurality of dividing walls extending from a rear side of said plurality of passageways; and a plurality of contact modules received in said insulating housing and arranged along a first direction, each contact module comprising an insulator and a plurality of conductive contacts received in said insulator;

wherein each insulator comprises a first section and a second section;

wherein the dimension of said first section along said first direction is larger than the dimension of said second section;

wherein when said contact modules are assembled to said insulating housing, said second sections are received in corresponding dividing walls, respectively.

2. The electrical connector as claimed in claim 1, wherein each said dividing wall defines a protrusion on a side face thereof, wherein a receiving channel is defined between said protrusions on adjacent two dividing walls, and wherein said second section of said insulator forms a block received in said receiving channel.

3. The electrical connector as claimed in claim 2, wherein said block includes a guiding portion slantedly assembled to said receiving channel and a main portion received in said receiving channel.

4. The electrical connector as claimed in claim 1, wherein said first section of said insulator defines a projection on a side face thereof and a receiving hole on an opposite face thereof.

5. The electrical connector as claimed in claim 1, wherein said conductive contact includes a contacting portion for engaging with a complementary connector, a mounting portion for mounting to the PCB, and an intermediate portion interconnecting said contacting portion and said mounting portion, and wherein at least one contacting portion is interference fitted in said insulating housing.

6. The electrical connector as in claim 1, wherein said insulating housing defines an abutting block formed in said passageway.

7. An electrical connector, comprising:

an insulating housing;

a plurality of power contacts received in said insulating housing; and a plurality of signal contact modules partially received in said insulating housing, each signal contact module comprising an insulator and a plurality of signal contacts retained in said insulator, said insulator comprising a first section and a second section, said second section providing a block, said first section providing a protrusion on one side thereof and a receiving hole on an opposite side, said protrusion of said signal contact module engaged with said receiving hole of a neighboring signal contact module;

wherein said insulating housing defines a plurality of passageways and a plurality of dividing walls, each dividing wall arranged between two adjacent passageways, and wherein said second section of said insulator is received in said passageway and positioned between two adjacent dividing walls, and wherein said first section of said insulator extends beyond said dividing walls.

8. The electrical connector as claimed in claim 7, wherein said dividing wall defines a receiving channel for receiving said block of said second section, and wherein one end of said signal contact is retained in said insulator and wherein at least one signal contact is interference fitted in said insulating housing.

9. The electrical connector as claimed in claim 8, wherein said signal contact comprises contacting portion, mounting portion and intermediate portion connecting said contacting portion and said mounting portion, said intermediate portion secured in said insulator and wherein at least one contacting portion forms a barb thereon for interference fitting in said insulating housing.

* * * * *